US005153362A

United States Patent [19]

Toda et al.

[11] Patent Number: 5,153,362

[45] Date of Patent: Oct. 6, 1992

[54] ELECTRONIC MUSICAL INSTRUMENT HAVING PAN CONTROL FUNCTION

[75] Inventors: Hiroyuki Toda; Fumihiko Ojima, both of Hamamatsu, Japan

[73] Assignee: Yamaha Corporation, Hamamatsu, Japan

[21] Appl. No.: 592,356

[22] Filed: Oct. 3, 1990

[30] Foreign Application Priority Data

| | | | |
|---|---|---|---|
| Oct. 4, 1989 | [JP] | Japan | 1-259063 |
| Oct. 4, 1989 | [JP] | Japan | 1-259064 |
| Oct. 4, 1989 | [JP] | Japan | 1-259065 |
| Oct. 4, 1989 | [JP] | Japan | 1-259066 |
| Oct. 4, 1989 | [JP] | Japan | 1-259067 |

[51] Int. Cl.[5] ..... H04S 5/00; G10K 15/08

[52] U.S. Cl. ..... 84/625; 84/DIG. 26; 84/DIG. 27; 84/DIG. 1; 381/1

[58] Field of Search ..... 84/DIG. 1, DIG. 26, 84/DIG. 27, 718, 604, 622, 625, 660; 381/1, 18

[56] References Cited

U.S. PATENT DOCUMENTS

| | | | |
|---|---|---|---|
| 4,577,540 | 3/1986 | Yamana | 381/1 |
| 4,648,115 | 3/1987 | Sakashita | 84/DIG. 26 |
| 5,025,703 | 6/1991 | Iba et al. | 84/718 |
| 5,027,689 | 7/1991 | Fujimori | 84/622 |

FOREIGN PATENT DOCUMENTS

| | | |
|---|---|---|
| 55-121492 | 9/1980 | Japan . |
| 68-160992 | 9/1983 | Japan . |
| 60-199300 | 10/1985 | Japan . |
| 62-183494 | 8/1987 | Japan . |
| 2189589 | 7/1990 | Japan . |
| 02189591 | 7/1990 | Japan . |

*Primary Examiner*—William M. Shoop, Jr.
*Assistant Examiner*—Helen Kim
*Attorney, Agent, or Firm*—Spensley Horn Jubas & Lubitz

[57] ABSTRACT

An electronic musical instrument having a pan control function includes a pan device for deciding a synthesizing rate of the plural wave form elements in each of the musical tone output terminals independently. Static pan control fixes an image position of a musical tone, and dynamic pan control changes the image position with lapse of time. The dynamic pan control also includes EG pan control which changes the image position on a pre-stored orbit and bias pan control which changes the image position based on specified data during playing. In addition to an operator, such as a jog dial and a modulation wheel, key touch data or key number data can be used for the bias pan control. This musical instrument can synthesize a musical tone signal by combining the pan control functions to each wave form element, thereby forming very widened musical tones.

14 Claims, 15 Drawing Sheets

Fig.3 number of settable voice :8(m=0~7)
number of element;4/voice(n=0~3)

| deta name | | register name | data range |
|---|---|---|---|
| | static pan data | SPAN (m) | -51~+50 |
| | depth control flag | AM (m) | 1/0 |
| | LFO depth data | LD (m) | 0~99 |
| | bias depth data | BD (m) | 0~99 |
| | controller assign flag | COLR (m) | 0/1/2 |
| | source assign flag | VKL (m) | 0/1/2 |
| | LFO constant | CONST (m,n) | 0~7 |
| | source depth data | SCD (m) | 0~99 |
| | selsct flag | SN (m,n) | 1/0 |
| EG pan data | delay time | DT | 0~99 |
| | key-on pan rate 1 | PR(1) (m,n) | 0~99 |
| | key-on pan rate 2 | PR(2) (m,n) | 0~99 |
| | key-on pan rate 3 | PR(3) (m,n) | 0~99 |
| | key-on pan rate 4 | PR(4) (m,n) | 0~99 |
| | key-off pan rate 1 | PR(5) (m,n) | 0~99 |
| | key-off pan rate 2 | PR(6) (m,n) | 0~99 |
| | key-on pan level 0 | PL(0) (m,n) | -50~+50 |
| | key-on pan level 1 | PL(1) (m,n) | -51~+50 |
| | key-on pan level 2 | PL(2) (m,n) | -51~+50 |
| | key-on pan level 3 | PL(3) (m,n) | -51~+50 |
| | key-on pan level 4 | PL(4) (m,n) | -51~+50 |
| | key-off pan level 1 | PL(5) (m,n) | -51~+50 |
| | key-off pan level 2 | PL(6) (m,n) | -51~+50 |
| | loop point | LOOP (m,n) | 0~3 |
| tone color data group<br>EG data group | | | |

Fig.4 (A)

| N | ON/OFF | key number | key touch |
|---|---|---|---|
| 0 | ON | KN1 | KT1 |
| 1 | ON | KN2 | KT2 |
| 2 | OFF | KN3 | - |
| | | | |

Fig.4 (B)

| N | controller number | control value |
|---|---|---|
| 0 | SN1 | B |
| 1 | SN2 | B |
| | | |

Fig.4 (C)

| channel number(c) | state flag (c) | key number KN (c) | Key scaling data KS(c) | key touch data KT(c) | assign voice ASS (c) |
|---|---|---|---|---|---|
| 0 | 1,0 | KN1 | KS1 | KT1 | ASS1 |
| 1 | 1,0 | KN2 | KS2 | KT2 | ASS2 |
| 2 | 0,1 | KN3 | KS3 | KT3 | ASS3 |
| | | | | | |
| | | | | | |
| 7 | 0,0 | | | | |

Fig.4 (D)

| |
|---|
| PAN (c,n) |
| PEG (c,n) |
| DEG (c,n) |
| R (c,n) |
| T (c,n) |
| PNB (n) |
| EG (c) |
| c |
| n |
| m |
| s |
| SF |
| VL |
| RT |
| BB |

Fig. 5 (A)

Voice Static Pan
MULTI:I-03 Tokyo Ensemble Labo
SELECTED VOICE:I-B02(18) YAPPY ELEP

| | | | | | | | |
|---|---|---|---|---|---|---|---|
| 01 **VC** | VOICE | | | 05 +55 | | | + |
| 02 +45 | | | + | 06 00 | + | | |
| 03 -33 | + | | | 07 VC | VOICE | | |
| 04 -08 | + | | | 08 -11 | + | | |

V1 V2 V3 V4 V5 V6 V7 V8

Fig. 5 (B)

Pan Source XXXX
PAN:I-04 Earthquake

PAN SOURCE = Key Note Number
SOURCE DEPTH = 47

Fig. 5 (C)

Controllers Set EL 1 2 XXXX
VOICE:I-B02(18) YAPPY ELEP

| SOURCE | DEPTH | DEVICE (MIDI CONTROL #) |
|---|---|---|
| PAN LFO | 60 | **001 Modulation Wheel** |
| PAN BIAS | 99 | 003 Assignable Wheel |

BEND MOD PAN FLTR BIAS VOLM

Fig. 5 (D)

Pan EG XXXX
PAN:I-04 Earthquake
L| EG Graphic
+ - - - - - - - - - - - - - - - - - - - - - - - - - - - - - - - - - - - - - -
R|

| DT | ONR1 | ONR2 | ONR3 | ONR4 | OFR1 | OFR2 |
|---|---|---|---|---|---|---|
| 35 | 69 | 63 | 88 | 82 | 15 | 46 |

RATE LVEL

Fig. 5 (E)

Pan EG XXXX
PAN:I-04 Earthquake
+(L)| EG Graphic
+ - - - - - - - - - - - - - - - - - - - - - - - - - - - - - - - - - - - - - -
-(R)|

| ONL0 | ONL1 | ONL2 | ONL3 | ONL4 | OFL1 | OFL2 | LOOP |
|---|---|---|---|---|---|---|---|
| 00 | +88 | -88 | +40 | -40 | +20 | +05 | S3 |

RATE LVEL

ELECTRONIC MUSICAL INSTRUMENT HAVING PAN CONTROL FUNCTION

BACKGROUND OF THE INVENTION

1. Field of the Invention

This invention relates to an electronic musical instrument which has several musical tone output sections, including a stereo output section, and more particularly to an electronic musical instrument having a pan control function which is capable of freely setting the image position of a generated musical tone.

2. Description of the Prior Art

The generally applied electronic musical instruments have a stereo output section designed to output the generated musical tone through the left and right channels (two channels), and the image position of the musical tone can be imparted to the outputted musical tone by adjusting the left and right channel output levels. Some electronic musical instruments can generate, simultaneously, two or more musical tones which have different tone colors. However, if the musical tones are generated at the same image position, the generated musical tones are less spread out. Therefore it has been proposed to shift the generation image position for each musical tone color (Japanese Patent Laid Open sho. 55-121492). This provides for a different image position of musical tone for each musical tone color, which makes it possible to create a sound field representing the ensemble if several musical tones are generated at the same time.

Nevertheless, the above-mentioned electronic musical instrument is able to set the sound output level of an analog musical tone signal independently through the left and right channels so as to provide the image position of musical tone. Therefore it can provide only the simple image position of musical tone and is unable to form the wider tone field specific to electronic musical instrument. Moreover, since image position fixing-/moving of each musical tone color can not be freely selected, sufficient play effect cannot be obtained.

The above-mentioned electronic musical instrument has the disadvantage that because the image position of each musical tone color is fixed at a specific point and the image position of musical tone cannot be moved during tone generation, pan control is impossible. This makes it impossible to form a diversified tone field.

Electronic musical instruments, such as a synthesizer capable of moving the image position of musical tone along the previously set orbit, are available. However, the orbit is maintained merely for several seconds. Therefore, if tone is outputted continuously for a longer time, image position is not moved further, so that tone diversification is lost.

Moreover, the above-mentioned move is effective only while the tone generation instruction is valid (during key-on time). Consequently, while reverberation is generated, the image position is fixed, resulting in poor diversification of tone.

The above-mentioned electronic musical instrument, such as the synthesizer, is designed so that only pan control is performed with the aid of an operator, such as a wheel, in the previously set range. Therefore it cannot control movement of tone image in complicated fashion, and the tone image movement effect cannot be obtained directly by the state of playing.

SUMMARY OF THE INVENTION

It is therefore an object of the present invention to provide the possibility of obtaining spread musical tone by providing the image position of musical tone independently for each wave form element composing the musical tone, and by ensuring optional selection of movement/fixing of the image position.

The second object of the present invention is to provide the possibility of obtaining the spread musical tone by changing the image position independently for each wave form element composing the musical tone by play operation.

The third object of this invention is to provide the possibility of pan control for a long time by looping the image position movement orbit.

The fourth object of this invention is to provide the possibility of moving the image position even after the musical tone is released.

The fifth object of this invention is to provide the possibility of executing pan control which differs depending on play operation or auxiliary operation, the possibility of setting the pan control range and the possibility of the above-mentioned setting for each wave form element in the case when a musical tone is composed of several wave form elements, thereby providing the possibility of more complicated pan control.

The electronic musical instrument the present invention is designed so that wave form elements composing an electronic musical tone can be positioned independently. Consequently, tone image positioning can be realized by adjusting the level of output to several musical tone output sections. As a result, several musical tone output sections output musical tones whose level and tone color differ from each other delicately, and the diversified image position of musical tone which is peculiar to electronic musical instrument can be obtained.

The electronic musical instrument of this invention is designed so that the image position of musical tone can be moved during playing by changing the synthesizing ratio of wave form elements with the lapse of time (dynamic pan). This makes it possible to variegate more the complicated movement of the image position of musical tone, thereby widening the spread of tone image which is peculiar to the electronic musical instrument.

Moreover, the electronic musical instrument of this invention enables selection of the dynamic pan to change the image position of musical tone with the lapse of time and the static pan to fix the image position. This ensures a wider range of playing.

The electronic musical instrument of this invention is designed so that the synthesizing quantity of several wave form elements composing a musical tone in each musical tone synthesizing section can be changed by playing operation, and a controller can be set independently for each wave form element. Data showing the depression state of a key which is turned on during playing can be used as control data. The image position of each wave form element can be variegated independently, which widens the spread of tone image peculiar to the electronic musical instrument.

The electronic musical instrument of this invention is designed so that the image position of musical tone is moved during tone generation with the lapse of time. Image position movement is realized by changing the output level ratio of each musical tone output section with the lapse of time. This change is executed based on the change orbit. The change orbit is obtained by storing the level indicating data in the storage area having consecutive addresses in order of time. Another available method is to store several peak values and change rates of the peak values as explained in the embodiment mentioned below. Since this change orbit has limited length, the change is repeated from the specified image position on the previously specified change orbit if it ends during tone generation. This specified image position is set by storing the address of the pertinent point and the peak value. Upon completion of the orbit, it is repeated by reading this data.

The electronic musical instrument of this invention has a feature that even after the generating musical tone is released (after key-off), the image position of the musical tone is moved with the lapse of time. The image position movement is executed by changing the output level ratio of each musical tone output section. This change is performed based on the change orbit. The change orbit is obtained by storing the level indicating data in the storage area having consecutive addresses in order of time.

Another available system is to store the several peaks and rates of the peaks as explained in an embodiment discussed below. This makes it possible to variegate the image position of musical tone even after musical tone is released, thereby improving expression.

The electronic musical instrument of this invention is designed so that the pan control is executed according to values composed of the control (main control means) based on the parameters (key-touch data and key number, etc.) generated as a result of musical tone specification operation such as key-on and of the control (sub-control means) based on other auxiliary operations (modulation wheel, etc.). This ensures pan control which well conforms to the play state and affords abundant expression.

The electronic musical instrument of this invention is designed so that the maximum control range of a main control means and a sub-control means in above-mentioned control can be specified. This enables the extent of the effect to be set during playing, thereby providing the effect best suited to play or music.

The electronic musical instrument of this invention makes it possible to select the above-mentioned main control means and sub-control means as necessary. Available main control means are the above-mentioned key number, key touch data, etc. Available sub-controllers are a modulation wheel, a slide volume, a jog dial, etc. These means allow matching with a player's choice or style.

The electronic musical instrument is able to control each of several wave form elements composing the musical tone in similar fashion to that mentioned above. Each of several wave form elements composing the musical tone can be controlled in similar fashion to that mentioned above. More complicated control is therefore is possible for the musical tone obtained by combining several wave form elements. Because the control means can be selected for each wave form element, the degree of freedom of playing can be enhanced.

BRIEF DESCRIPTION OF THE DRAWINGS

FIGS. 3 and FIG. 4 (A)-(D) show a configuration of the memory of this electronic keyboard instrument. FIG. 5 (A) to (E) show examples of displays of this electronic keyboard instrument.

DESCRIPTION OF THE PREFERRED EMBODIMENT

Figure 2:
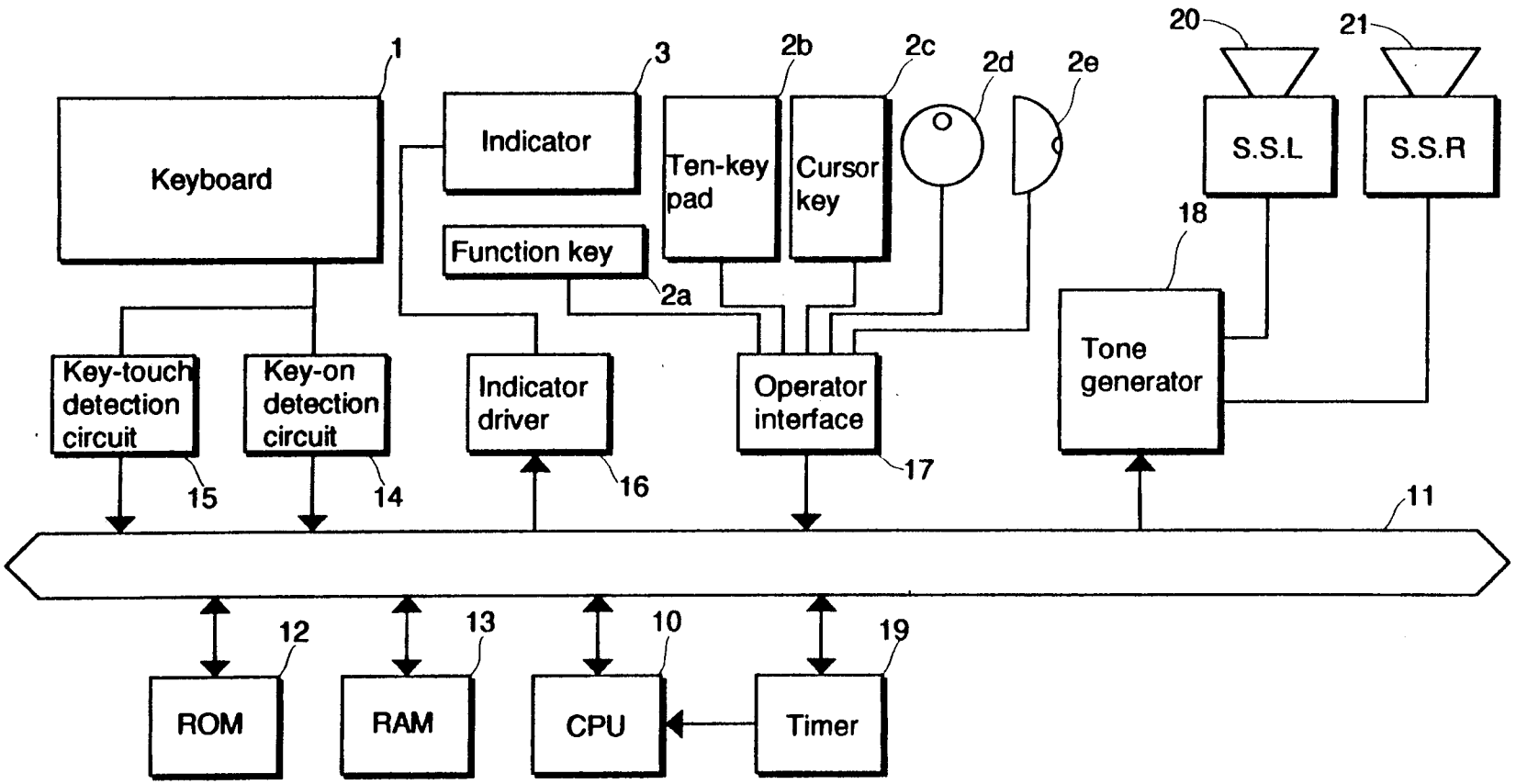
FIG. 2 is a block diagram of the control section of this electronic keyboard instrument.

FIG. 2 is a block diagram of the control section of an electronic keyboard instrument which is an embodiment of the invention. This electronic keyboard instrument is provided with a keyboard 1 having a range of about 5 octaves. The pitch of a musical tone to be generated can be specified by using this keyboard. The specified musical tone is generated from the sound systems (SSL20, SSR21) of left and right two channels. The musical tones are set in various image positions by a static pan control and a dynamic pan control. The static pan control is a control system designed so that the tone generation levels of left and right channels are fixed with specific rate so as to form the tone image in a specific pan image position. The dynamic pan control is a control designed so that the pan image position is shifted to the left or right by real time operation using the operator and envelope generator pan (EG pan). In case of the dynamic pan control the pan image position is controlled by two control elements, namely main controller and subcontroller, and EG pan. The parameters generated according to play operation of the keyboard 1 are assigned mainly to the main controller. Other operators (or parameters generated by other operators) are mainly assigned to the subcontroller. The EG pan control is a control system designed so that the image position of musical tone move pattern with the lapse of musical tone generation time is generated based on specific parameters. The pan image position decided by the above-mentioned main controller and subcontroller and the other pan image position generated by the EG pan are merged to perform the dynamic pan control.

The control panel of this electronic keyboard instrument is provided with an operator 2 and an indicator 3. Provided as the operator 2, are a function key 2*a*, a ten-key pad 2*b*, a cursor key 2*c*, a jog dial 2*d*, and a modulation wheel 2*e*. A function key 2*a* is provided adjacent to the indicator 3. Operations of this electronic keyboard instrument are controlled by a CPU 10, to which a bus 11 is connected. A ROM 12, a RAM 13, a key-on detection circuit 14, a key-touch detection circuit 15, an indicator driver 16, an operator interface 17, a tone generator 18 and a timer 19 are connected to the bus 11. A program to control operations of the electronic keyboard instrument is stored in the ROM 12. Register areas shown in FIG. 3 and FIG. 4 are set in the RAM 13. This RAM 13 is backed up by a battery. Its stored data is not lost even after the power supply is turned off. The key-on detecting circuit 14 and the key-touch detecting circuit 15 are circuits to detect key pressing speed when the key is turned on. A key-on signal and key-touch data are sent to the CPU 10 through the bus 11. The indicator driver 16 is a circuit to actuate the indicator 3. The indicator 3 is a liquid crystal matrix type indicator capable of displaying any characters and figures. It indicates data sent from the CPU 10. The operator interface 17 detects the operation state of the above-mentioned operators 2*a* to 2*e* and sends data to the CPU 10. The tone generator 18 is a device designated to generate musical tone based on the musical tone sent from the CPU 10. The tone generator 18 has 8 lines of musical tone synthesizing section. Each musical tone synthesizing section has a function to synthesize musical tone independently for the left and right channels. A left sound system 20 and a right sound system 21 are connected to the tone generator 18. Therefore, the musical tone signals synthesized separately at the left and right sides can be outputted individually.

FIG. 3 and FIG. 4 indicate the register areas which are set in the above-mentioned RAM 13.

FIG. 3 shows a list of voice data storage area registers designated to store the data of tone color (voice) which can be generated by this electronic musical instrument. Substantial tone color data (64 tone colors or so) is stored in this electronic keyboard instrument. Of all tone colors 8 tone colors, (m=0 to 7) can be set in the storage area as tone colors which can be generated simultaneously. Each tone color consists of 4 elements (wave form element: n=0 to 3). Each register is set for each voice (m) or for each element (m, n). Accordingly, for example, the register SPAN (m) consists of 8 registers, and the register SN (m, n) consists of 32 registers.

The static pan data SPAN (m) (hereinafter a sequence of data name and register name is used) comprises data representing the pan image position in the static pan control. The data range is −51 to +50. When −50 is set, the pertinent musical tone is set in the image position of the left channel. If +50 is set, the musical tone is set in the image position of right channel image position. If an intermediate value is set, the musical tone is set in the intermediate image position corresponding to this value. That is, the musical tone is generated from both left and right channels with a specific balance. If −51 is set, the dynamic pan is executed.

The depth control flag AM (m) and the controller assign flag COLR (m) are flags designated to specify the subcontroller in the dynamic pan. When the depth control flag AM(m) has been set, the built-in LFO (Low Frequency Oscillator) serves as a subcontroller. When the AM (m) has been reset, an operator specified by the control assigned flag COLR(m) serves as a subcontroller. When the COLR(m) is 0/1/2, the cursor key 2*c*, modulation wheel 2*e* or jog dial 2*d* becomes a subcontroller, respectively.

The LFO depth data LD(m) is data which specifies the intensity of control by the LFO when the LFO is assigned to be the subcontroller.

The bias depth data BD(m) is data which specifies the intensity of control by an operator when the operator is assigned to be the subcontroller.

The source assign flag VKL(m) is a flag which specifies the main controller of the dynamic pan. This flag is a 0/1/2 three state flag. When it is set to "0", the key-touch intensity of the key which has specified the pertinent musical tone becomes a main controller. When the flag is set to "1", the key number of the key which has specified the pertinent musical tone becomes a main controller. When it is set to "2", the LFO provided separately becomes a main controller.

The LFO constant CONST(m, n) is constant data to set angular frequency of the LFO when this LFO is assigned to be a main controller.

The source, depth data SCD(m) is data to set the control intensity of the main controller.

The select flag SN (m, n) is a flag which indicates whether or not the element specified by n has been selected to generate musical tone. If voice m is specified after this flag has been set, this element generates musical tone. If it has been reset, the element does not generate musical tone even when the voice m is specified.

In this memory area the memory area of parameters (EG pan data) to calculate the EG pan is also set.

Figure 6:
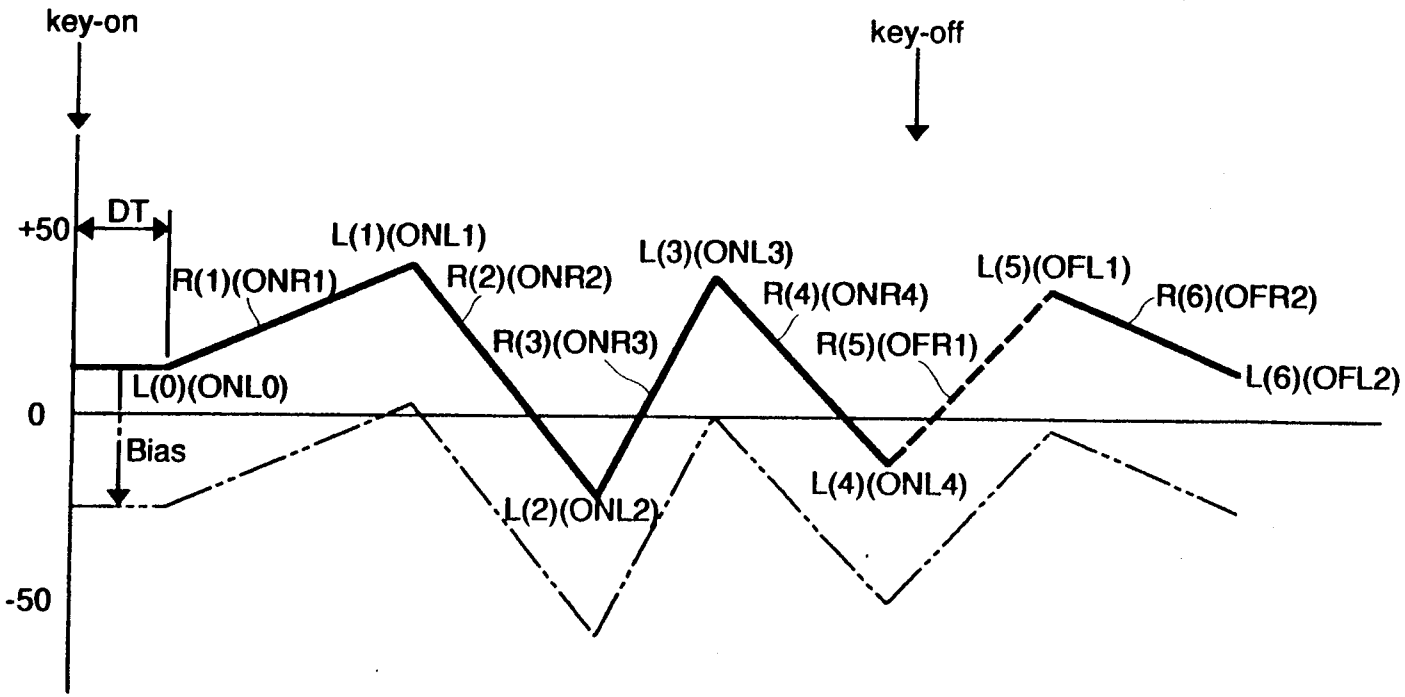
FIG. 6 shows the state of EG pan of this electronic keyboard instrument.

Delay time DT (m, n), key-on pan rate 1 to 4, key-off pan rate 1 and 2 (PR(s)(m, n): s=1 to 6), key-on pan level 0 to 4, key-off pan level 1 and 2 (PL(s) (m, n):s=0 to 6) and loop point LOOP (m, n) are stored as the EG pan data. The pan envelop as shown in FIG. 6 is calculated by using these data. That is, after the lapse of delay time DT following key-on, the tone image shifts successively during key-on according to the key-on pan level 0 to 4 which indicates the top of the pan envelope during key-on, and the change rate during shift is specified by the key-on pan rate 1 to 4 In the figure, R represents Rate, and L represents Level. If the key-on state remains when the key-on pan level 4 is reached, the envelope initiated from the key-on pan level image position specified by LOOP is repeated again. After key-off the image position is controlled by the key-off pan level 1 and 2 indicating the top of the pan envelop during key-off and the key-off pan rate 1 and 2 indicating the change rate between levels until the musical tone is completely decayed. In this case, too, the image position is repeatedly traced between key-off pan level 1 and 2 until the tone decays. Delay time DT is a time lag until the start of pan from key-on pan level 0 to key-on pan level 1.

In addition to these data, a tone color data group deciding the musical tone wave form of elements and the EG data group deciding the tone generation level are stored in the voice memory area.

FIGS. 4 (A) to (D) show the register group except for the above mentioned voice data.

FIG. 4 (A) shows a key event buffer. If key-on or key-off is executed, its data is stored in this buffer. Data to be stored is discrimination data of key-on and key-off, key number data and key touch data. In the case of ordinary key-on/off, data is stored in the N=0 area. In the case where several events occur concurrently as in the pressing of chord keys, data is stored in order of N=0, 1, 2 . . . .

FIG. 4 (B) shows an operator data buffer. The operation state of operators 2*a* to 2*e* is stored in this buffer.

FIG. 4 (C) shows a channel register. It stores key-on data which is assigned to each of 8 musical tone synthesizing sections (hereinafter referred to as channel; c=0 to 7) of the tone generator 18. Applicable key-on data are state flag ST(c), key number KN(c), key scaling data KS(c), key touch data KT(c) and assign voice ASS (c). Here, the state flag ST(c) is a 2-bit flag indicating the current tone generating state. If this flag is "10", it indicates key-on state, whereas "01" indicates the release state after key-off (but the tone is being generated). If the flag is "00", it indicates that musical tone is not assigned to the pertinent channel. Key number KN (c) is a key code (pitch code) specified by the ON key. With the electronic keyboard instrument, the pitch specified by a key is not fixed, and it can be freely set by the player in advance. Therefore, when the key-on mode is set, the set table (not shown in the figure) is retrieved according to the specific key number to get the key scaling data KS (c). Assign voice ASS (c) is a tone color number (voice number) of musical tone which is generated corresponding to key-on.

FIG. 4 (D) shows a register group which is used in case of timer interrupt operation of the CPU 10. PAN (c, n) is a register to store the EG pan data (pan image position data which is calculated by the pan EG) of a pertinent element of voice assigned to a specific channel.

PEG (c, n) is a register to store the step at which the EG pan of a pertinent element exists. The EG pan step takes a value corresponding to the target value (pan level PL (s) (m, n)) to which the processing is now directed.

DEG (c, n) is a register to store the advance angle of LFO in the case when the main controller is LFO.

R (c, n) is a register to store the change rate at a specific step of EG pan. This change rate is calculated from PR (s) (m, n).

T(c, n) is a timer register for counting delay time.

PNB (n) is a buffer of final pan data obtained by merging pan data given by a main controller, a subcontroller and an EG pan. The number of registers is equal to the number of elements of one voice. Data is sent to the musical tone synthesizer (tone generator 18) where it is used as a musical tone parameter. Since data is sent to the musical tone synthesizer for each channel, registers for one channel (for 4 elements) are needed.

EG (c) is EG data of a tone generation level. This data is also calculated by timer interrupt operation.

"c" represents a channel counter, and "n" represents an element counter. These registers are increased, one by one, since processing is performed for all elements by timer interrupt operation. "m" is a voice number pointer, and "s" is an EG pan step pointer. The value of PEG (c, n) is substituted. These pointers are used to refer to the voice data storage area.

SF is an EG bias data register to store EG data provided by a main controller and a subcontroller.

VL is a main pan bias data (pan bias data given by main controller) storing area, and RT is a subpan bias data (pan bias data given by subcontroller) storing area.

BB is a buffer area to store operation data of a subcontroller.

Figure 1:
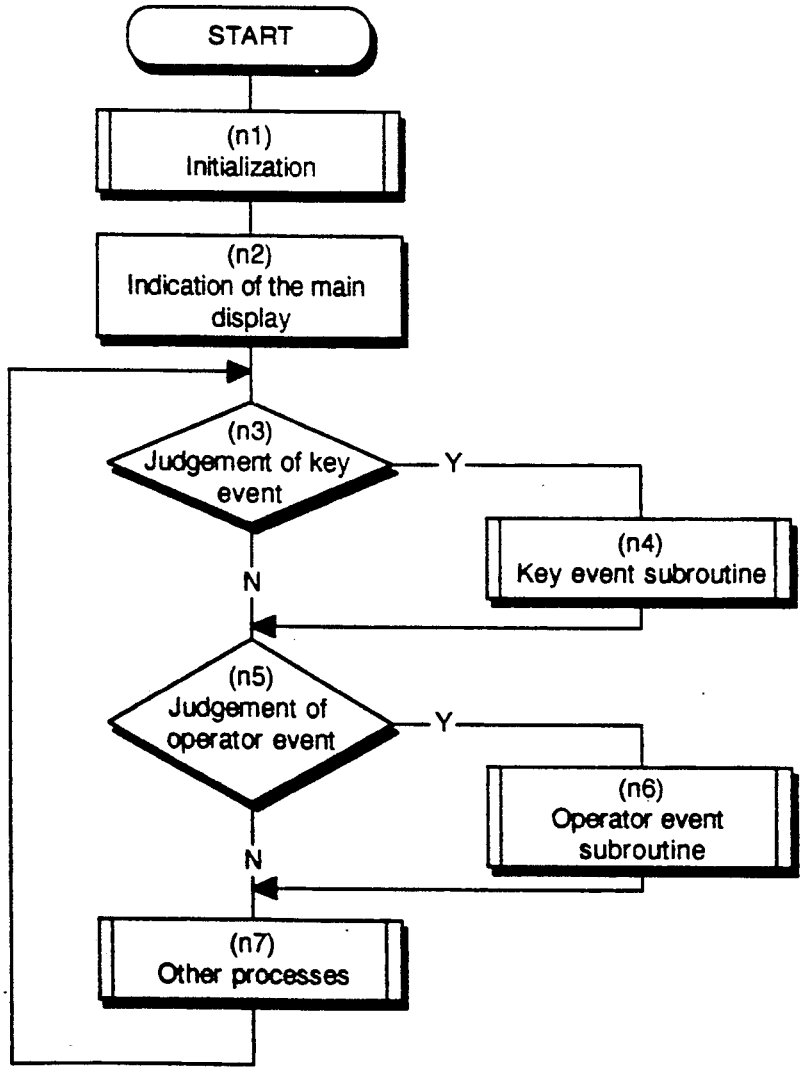
FIGS. 1 (A) to (I) are flow charts showing the operations of the control section of an electronic keyboard instrument which is an embodiment of this invention.
Figure 1:
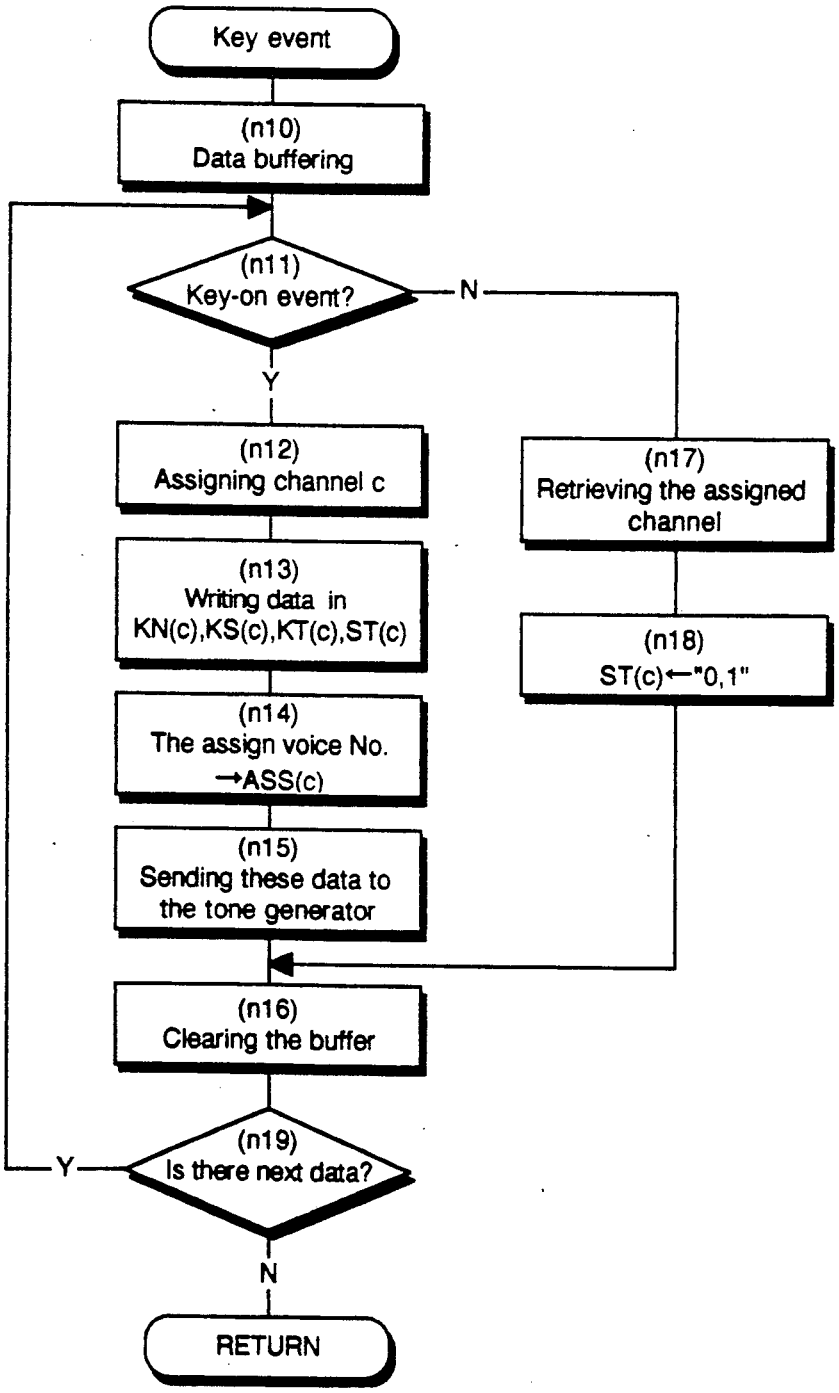
Figure 1:
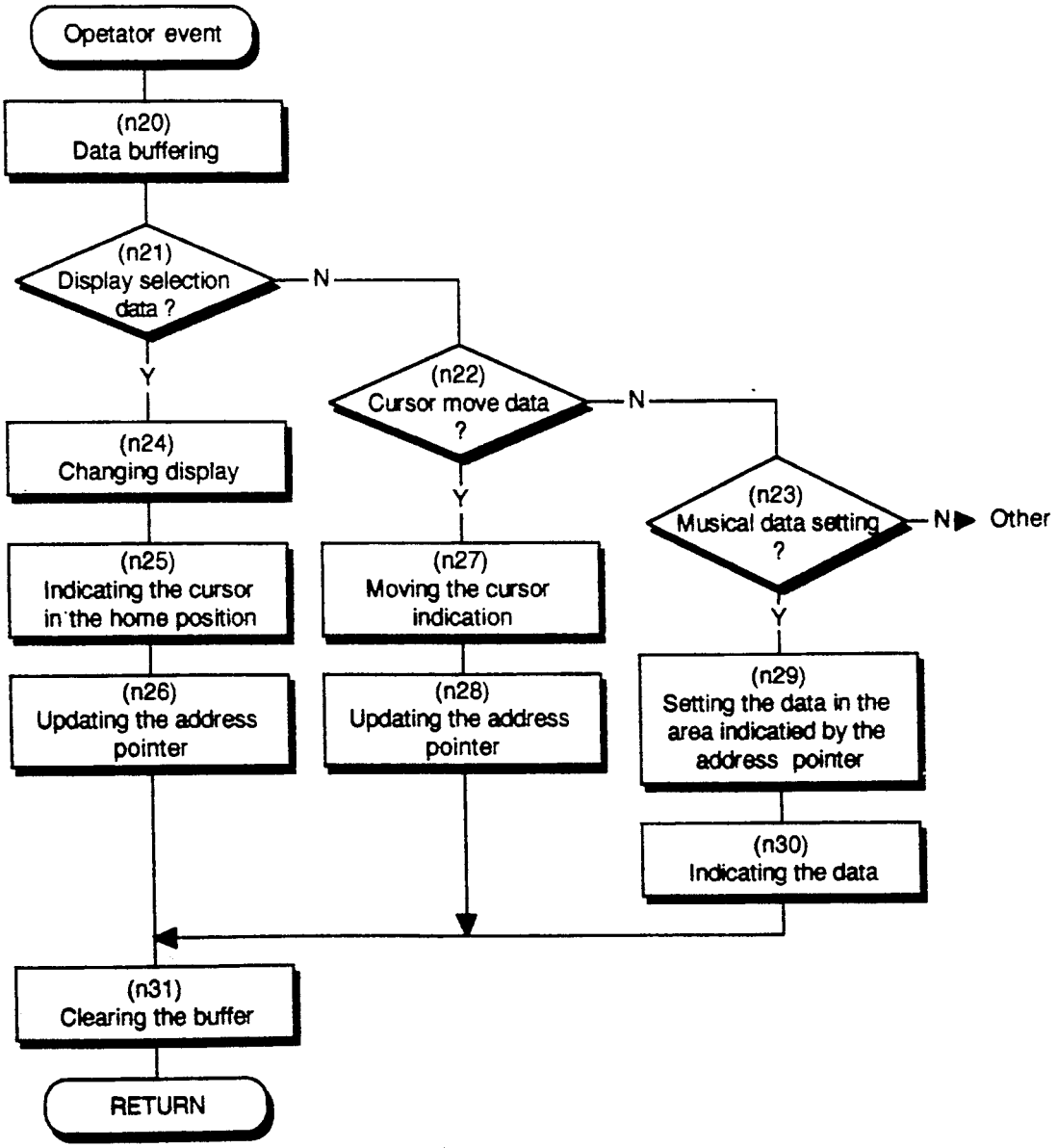
Figure 1:
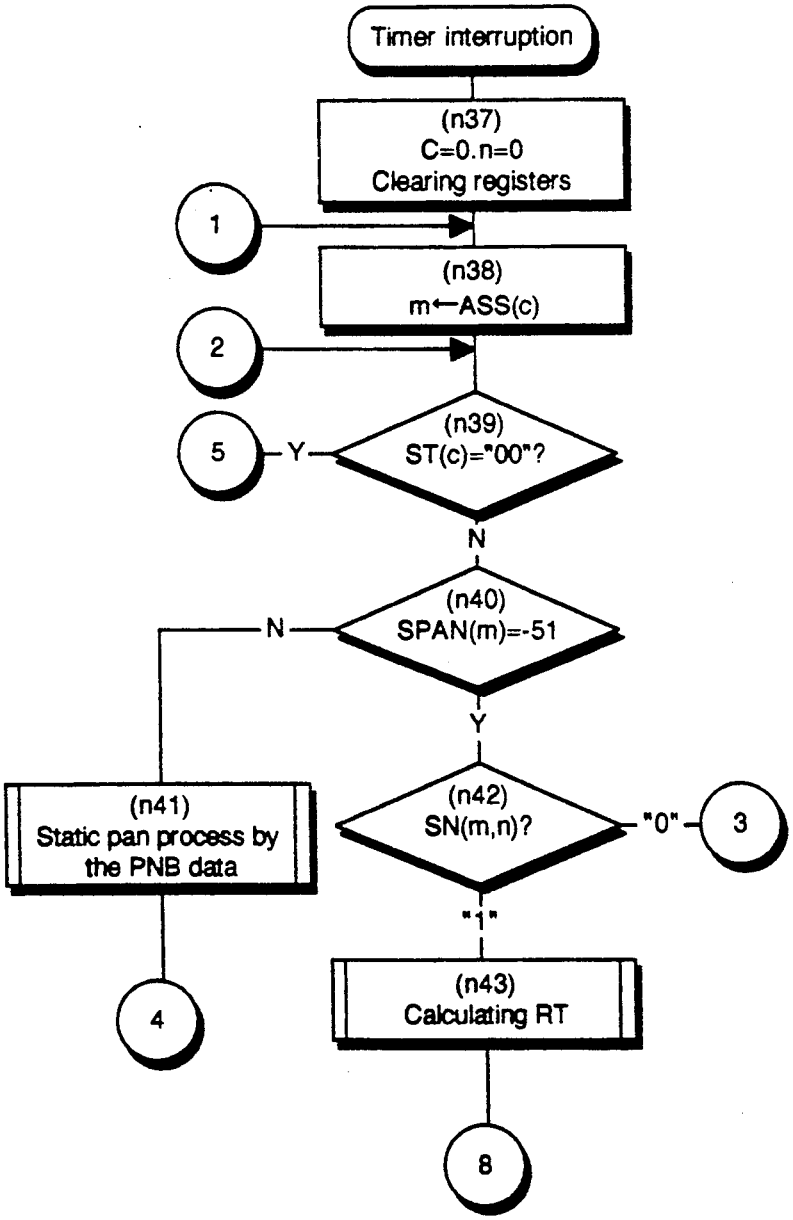
Figure 1:
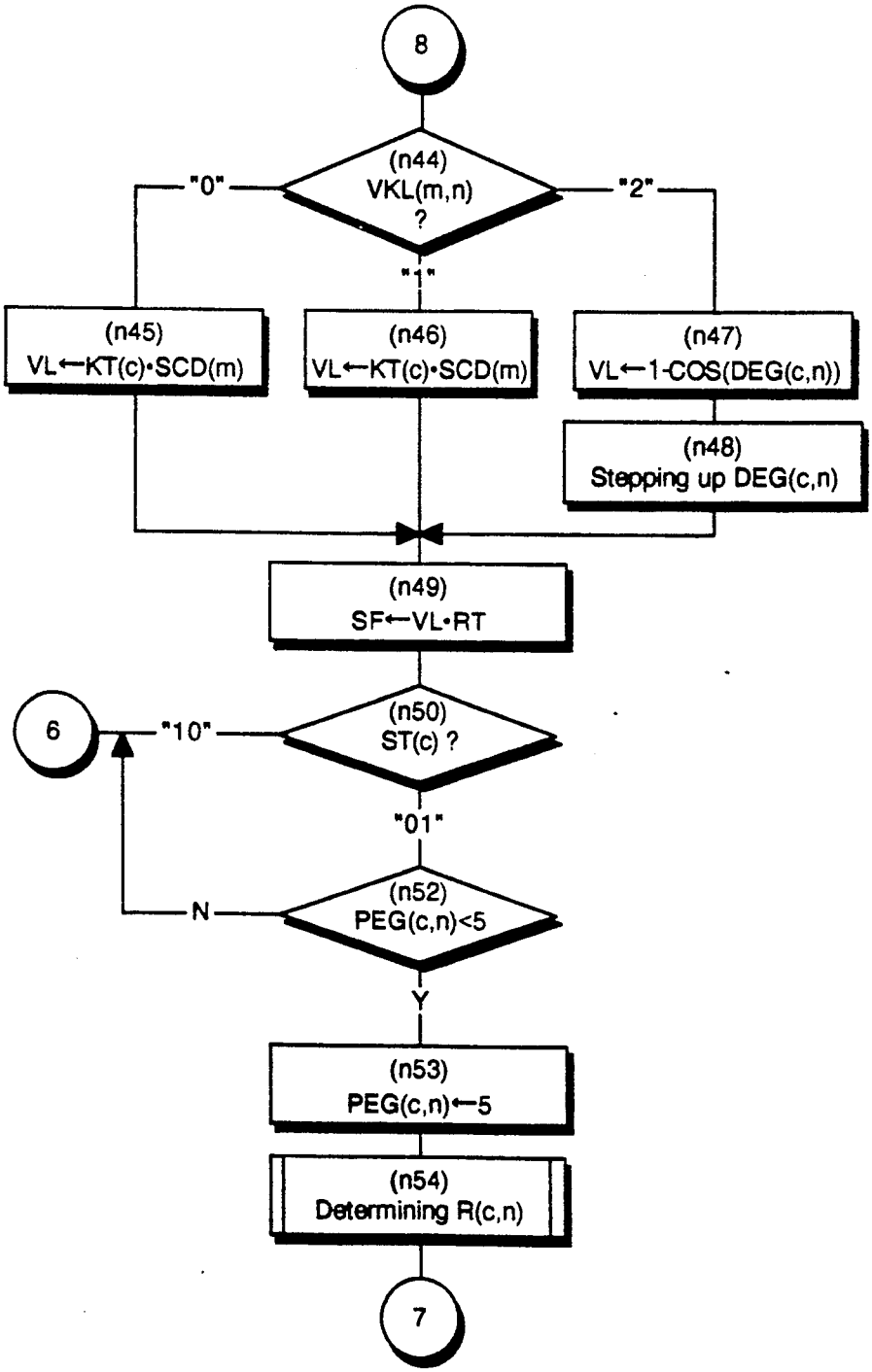
Figure 1:
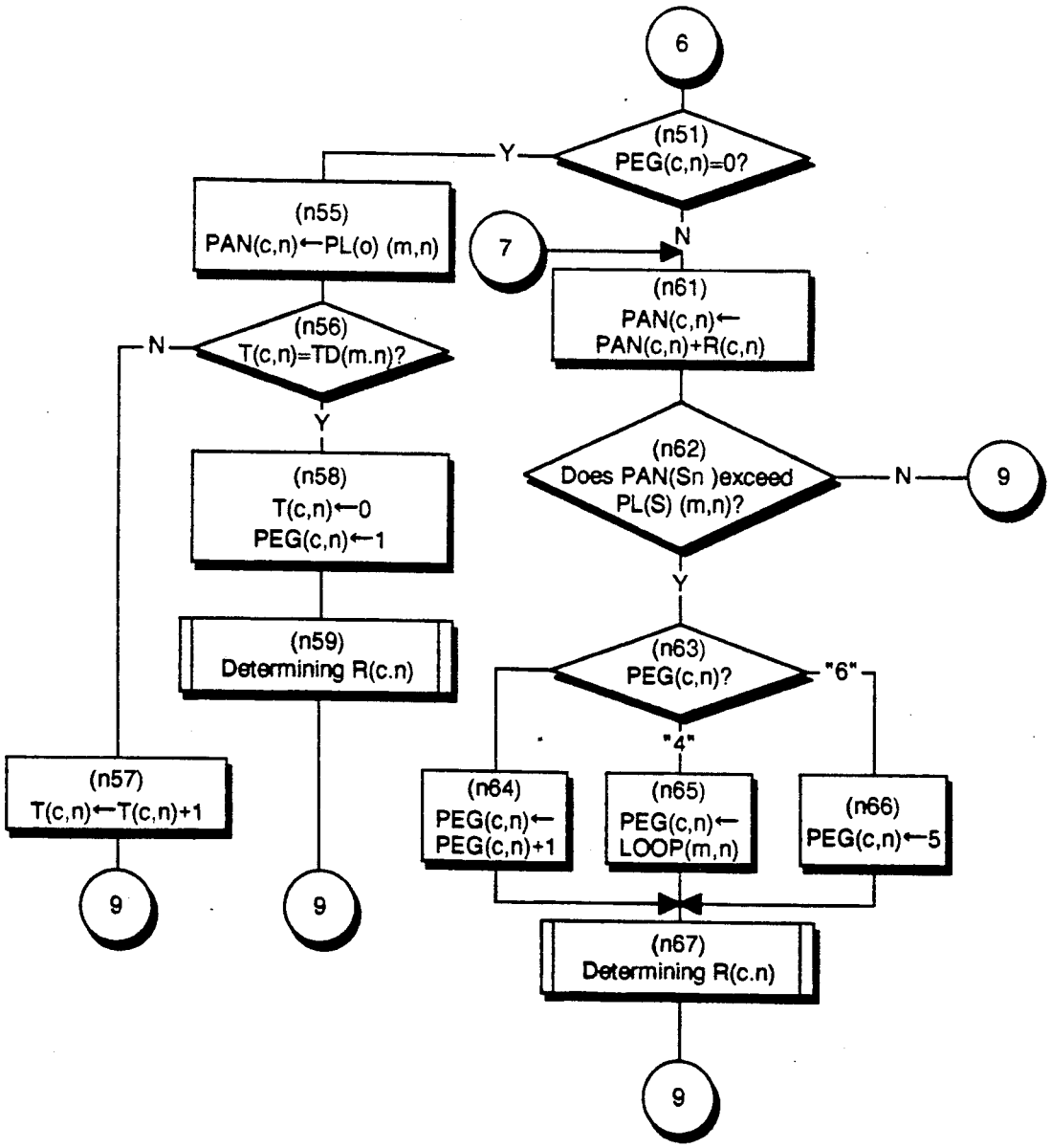
Figure 1:
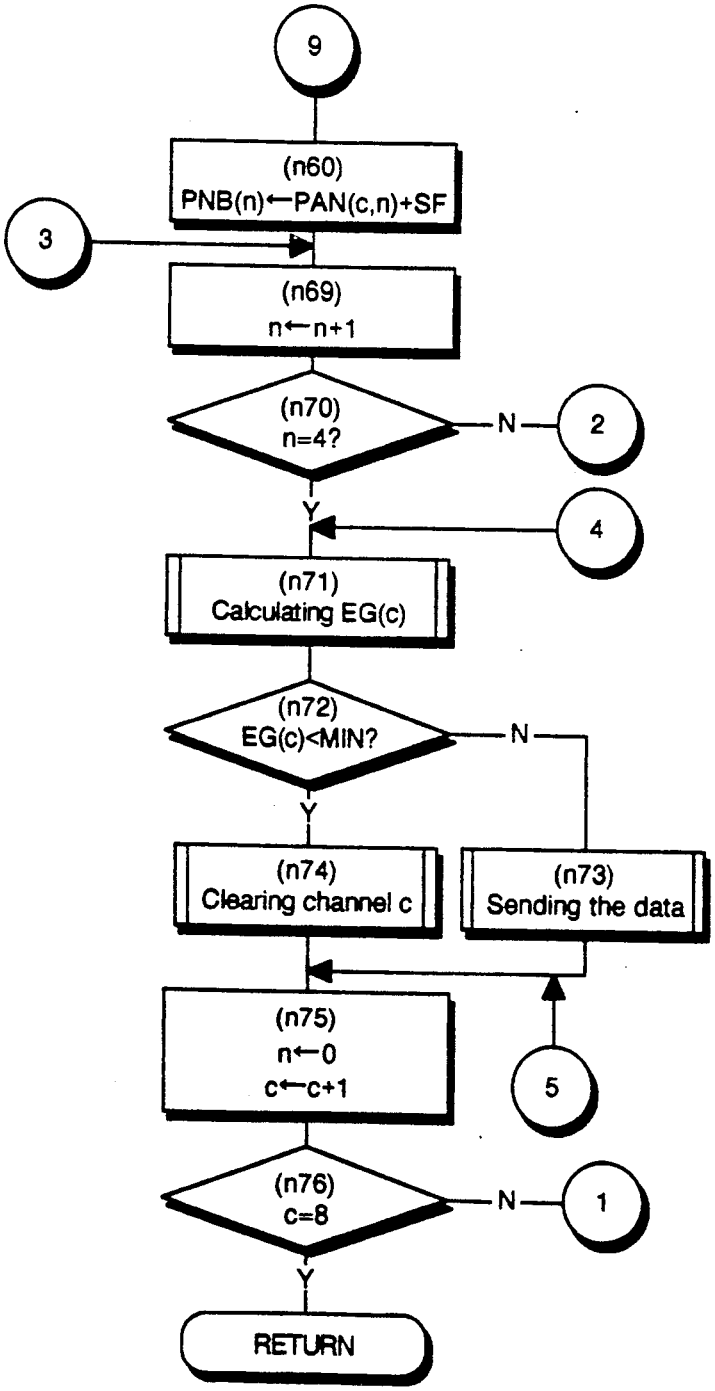
Figure 1:
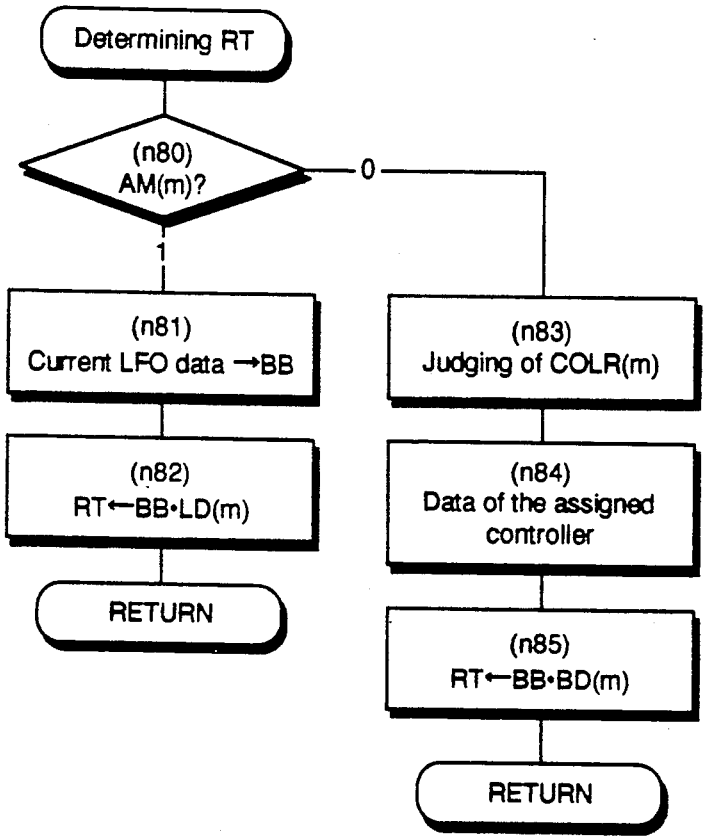
Figure 1:
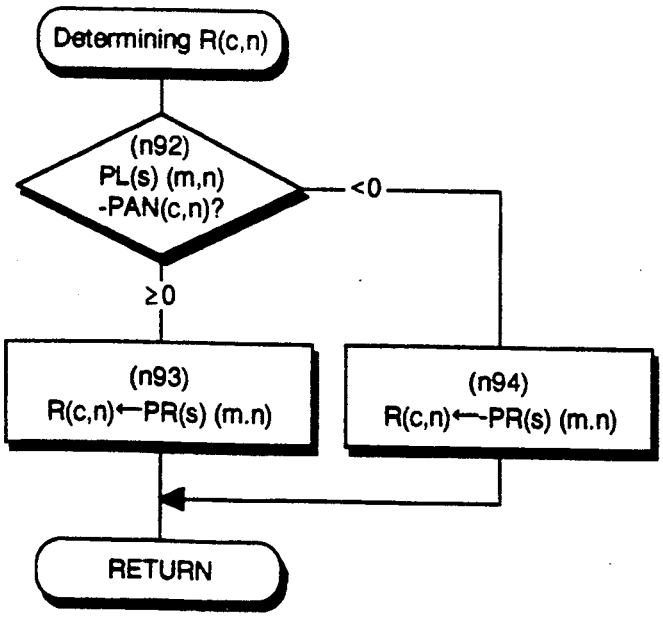

FIG. 1 is a flow chart showing the operation of the control section of the electronic keyboard instrument. FIG. 5 (A) to (I) show examples of display of the indicator 3. Below is an explanation of operation of the electronic keyboard instrument.

FIG. 1 (A) is a main routine. When the power supply of the electronic keyboard instrument is turned on, the operation is started. At first, at the step n1, the initialization, such as clearing, is performed. After completion of initialization, the main display is indicated(n2). In this state, an ON/OFF event (n3) of the keyboard 1 and the operation of operator 2 connected to the operator interface 17 are accepted (n5). If an event occurs, the pertinent subroutine (n4, n5) is executed. Main volume control of a musical tone being generated is executed (n7). While power is turned on, operation of steps n3 to n7 is repeatedly executed.

FIG. 1 (B) shows a key event subroutine. When a key ON/OFF event occurs, its data is sent to the key event buffer (see FIG. 4 (A))(n10), and a judgment as to whether this event is a key ON event or a key OFF event is performed (n11). If it is a key ON event, a tone generation channel (musical tone synthesizing section c) is assigned to key ON musical tone (n12), key number KN(c), key scaling data KS (c), and key touch data KT(c) are written in the assigned channel register (see FIG. 4 (C)), and "10" is written in the state flag ST (c) (n13). Then, a voice to be generated in this channel is determined based on the key number, etc. and written in tho assign voice register ASS (c) (n14). These data are sent to the channel c of the tone generator 18 (n15). The key event buffer storing this event data is cleared (n16), and if next there is buffering data, the process returns to the step n11 (n19). If there is no next buffering data, the process returns. If the taken-in data is a key OFF event, a channel to which the OFF key has been assigned is retrieved (n17), ST(c) of its channel register ST (c) is rewritten to "01" (n18), and the process proceeds to the step 16.

FIG. 1 (C) shows an operator event subroutine. When the operator is operated, its operation input is put into the operator data buffer (see FIG. 4 (B)) (n20), and judgment as to whether this operation input is a display selection input, a cursor move input or a data setting input (n21 to n23) is executed. If it is a display selection input (n21), the display (see FIG. 5) of the indicator 3 is changed to the specified display (n24), and the cursor is indicated in the home image position of this display (n25). The address pointer is set in the register at the image position where the cursor is indicated (n26). This address pointer indicates the address of various registers as shown in FIG. 3 and FIG. 4. It is possible to set data in the register at the specified address. If the input is a cursor move input (n22), the cursor indication is moved according to input state (n27), and pertinent address pointer is updated (n28). If the input is a data setting input(n23), the inputted data is set in the register area indicated by the address pointer, and data indicated by the indicator 3 is changed so that it matches with the input data (n30). After these operations the operator data buffer is cleared (n31), and the process returns.

Data of the voice data storing area shown in FIG. 3 can be changed by this operation. For example, FIG. 5(A) shows a display to accept the input of voice static pan data SPAN (m). FIG. 5 (B) shows a display to accept the specification of a main controller (pan source). FIG. 5 (C) shows a display to accept the specification of a subcontroller. FIG. 5 (D) and FIG. 5 (E) show a display to accept a set of EG pan data. If the setting personnel (player) moves the cursor to the specific image position and enters data after indicating such a display on the indicator 3, data in the column indicated by the cursor is updated.

FIGS. 1 (D) and (E) show timer interrupt operation. This operation is executed by interruption at specific timing of the timer 19. If this operation is started, 0 is set in the channel counter c and the element counter n (n37), and this operation is executed from the 0 element of 0 channel. At first the voice number assigned to the channel c is set to the voice number pointer m (n38), and the state flag ST (c) of channel c is referenced (n39). If ST (c) is "00", this means that the channel c is not generating tone.

Consequently, the subsequent processing is not performed but a jump to the step n75 to update the specific channel is performed. If ST (c) is "10" or "01", musical tone is being generated. Therefore the static pan data SPAN (m) of voice number m assigned to the channel c is judged (n40). If the content of SPAN (m) is not 51, this means that the static pan has been set. In this state the pan data is specified based on this data, and stored in the pan data buffer PNB (n41). Then the process jumps to the step n71 to create data to be sent to the tone generator 18. If the content of SPAN (m) is −51, this means that the dynamic pan has been set. Consequently, the operation of step n42 and on is performed.

At first, at the step n42 a judgment as to whether or not the element currently processed has been selected as a tone generating element is made based on the select flag SN (m, n). If it is not selected, the process jumps to the step 69 to execute the processing for the next element. If this element has been selected, the subpan bias data RT given by a subcontroller is calculated (n43 see FIG. 1 (F)). Thereafter the source assign flag VKL (m) is referenced to determine what is assigned as a main controller (n44). In the case when the key-touch data KT(c) is assigned as a main controller, KT (c) is multiplied by source depth data SCD (m) specifying the control intensity to calculate the main pan bias data VL (n45). In the case when the key number KN (c) is assigned as a main controller, VL is obtained by the calculation KN(c)×SCD (m) (n46). If LFO is assigned as a main controller, its oscillation operation is executed at the steps n47 and n48. Namely, at the step n47 a calculation of VL=1 - COS (DEG(c, n)) is executed to obtain VL. At the step n48 the advance register DEG (c, n) is advanced. The advance calculation is: DEG (c, n)=DEG (c, n)+CONST (c, n). MOD. 360

Next, bias data SF is obtained by calculation VL×RT (n49) to judge again the state of ST (c) (n50). If ST (c) is "10", this means that the current state is a key ON state. Consequently, the process proceeds to the step n51 to determine the EG pan step PEG (c, n). If ST (c) is "01", this means that the current state is a release state. Therefore the value of the EG pan step data PEG (c, n) is judged at the step n52. If PEG (c, n) is less than 5, as is evident from FIG. 6, this means that this operation is executed first after key OFF (because PEG (c, n)<5 is the step in the key ON state). In this case 5 is inputted into PEG (c, n)(n53), and the pan rate R (c, n) is determined (n54; see FIG. 1 (G)). Then the process proceeds to the step n61. If at the step n52 PEG (c, n) is not less than 5, namely equal to 5 or 6, the process proceeds to the step n51.

At the step n51, PEG (c, n) is examined. If it is 0, this means that the current state is a delay time state. Therefore the process proceeds to the step n55 and on. In other cases the current state is the EG pan state. Therefore the process proceeds to the step n61 and on.

At the step n55 the current state is the delay time state. Therefore the first key ON pan level PL (0) (m, n) is substituted in the EG pan data PAN (c, n) since the current state is the delay time state. The timer register T (c, n) is compared with the delay time data TD (m, n) (n56). If they are not equal to each other, the delay time remains. Therefore 1 is added to T (c, n) (n57), and then the process proceeds to the step n60. If T(c,n)=TD(m, n), the timer register T (c, n) is cleared since the delay time has elapsed. A value of 1 which denotes the next step, is set in the EG pan step register PEG (c, n) (n58), a new EG pan rate R (c, n) is determined (n59), and then the process proceeds to the step n60.

The step n61 and on is an EG pan operation. In this operation the value of PEG (c, n) is substituted in s. At first, pan rate R (c, n) is added to the EG pan data PAN (c, n) to generate a new EG pan data (n61). Next, a judgment as to whether or not the new PAN (c, n) exceeded the pertinent target PL(s) (m, n) is performed (n62). If it did not exceed, this means that the EG pan step continues. Therefore the process proceeds directly to the step n60. If it exceeded, the current EG pan step PEG (c, n) is determined since the process proceeds to the next EG pan step (n63).

Unless PEG (c, n) is "4" or "6", 1 is added to PEG (c, n) (n64). After a new EG pan rate R (c, n) is determined (n67), the process proceeds to the step n60. When PEG (c, n) is "4" or "6", EG must be looped. Therefore, if PEG (c, n)=4, LOOP (m, n) is substituted in PEG (c, n) (n65). If PEG (c, n)=6, 5 is substituted in PEG (c, n) (n66). Then the process proceeds to the step n67.

At the step n60 the pan bias data SF is added to the EG pan data PAN (c, n) to calculate and store the pan data PNB (n). Pan data for one channel is sent to the tone generator 18. After that, "1" is added to n (n69) to repeat the same operation for the next element. The process returns to the step n39 until n becomes equal to 4(n70). If n becomes equal to 4, this means that the above-mentioned operation has been performed for the 4 elements (n=0 to 3). Hence, EG (c) is calculated based on the pan data, EG data group, etc. (n71). If the calculated value of EG (c) is smaller than the minimum tone generation level MIN (stored in the ROM12)(n72), the required processing is determined to be tone decay, and therefore the channel c is cleared (ST(c)="00") (n74). If EG (c) is higher than MIN, tone generation is continued. Therefore the tone generation data including EG (c) and above-mentioned PNB (n) are sent to the tone generator 18 (n73). After that, n is set to "0" so as to execute the same operation for the next channel, 1 is added to c, and then the process returns to the step n41. If the result of addition reaches 8, this means that the above-mentioned operation has been finished for all the channels, namely channels 0 to 7. Hence, the process returns.

FIG. 1 (H) shows a subroutine to decide the subbias data RT. At first the depth control flag AM(m) is referenced to judge whether the subcontroller is LFO or the operator (n80). If AM(m) has been set, this means that the subcontroller is LFO. Therefore the current value of LFO is read into a buffer BB (n81). Value of this BB is multiplied by LFO depth data LD(m) which is control intensity (n82). If AM(m) has been reset, the subcontroller is one of operators. Therefore a judgment as to what operator has been assigned is performed based on the controller assign flag COLR (m) (n83). The operation amount data of the assigned operator is sent to the buffer BB (n84). Data of this BB is multiplied by bias depth data BD (m) which is control intensity to get LT (n85). After completion of the above-mentioned operation the process returns.

FIG. 1 (I) shows a subroutine to determine the EG pan rate R (c, n). At first, EG pan data PAN (c, n) is compared with target value PL(s) (m, n) (n92). If PAN (c, n) is larger, hereinafter panning must be executed in a negative direction. Therefore, the pan rate PR(s)(m, n) corresponding to this step is made negative and set to R(c,n) (n94). In other case the pan level PL(s)(m, n) corresponding to this step is set to R(c, n) (n93). Then the process returns. In the above-mentioned embodiment tho image position of musical tone can be shifted by multiplying by EG pan and pan bias for each element composing the voice. Extremely complicated image position control of musical tone can be realized. Moreover, since the pan bias is designed so that the main controller (source) and the subcontroller (bias) are combined, more complicated control becomes possible. Consequently, because the main controller is designed so as to get the parameters from real play using the keyboard, details of play can be expressed better. As the subcontroller takes the parameter from the operations of operators other than keyboard, additional effect can be added. In this embodiment EG pan is executed linearly by adding rate. Pan in the form of a curve is also possible by multiplying the value of PAN (c, n) by a rate.

In this embodiment the tone color is set by using the key codes for multi sounds. Other variations, such as tone generation with 8 tones with respect to one key code with the aid of 8 channels for pure tone, are possible.

Thus, the above-mentioned electronic musical instrument can change the synthesis level to output to a pertinent musical tone output section for each of several wave form elements composing a musical tone. Consequently, the complicated tone image can be made even for one musical tone, so that an effective unique play effect, peculiar to the electronic musical instrument, can be obtained.

Moreover, since the complicated tone image can be shifted with the lapse of time or fixed in a specific image position, higher expression ability is obtained.

The controllers can be set independently for several wave form elements. Therefore, it is possible to give the extremely complicated fixed image position effect to a musical tone during playing. This allows the electronic musical instrument to form a unique tone field, thereby enhancing its expression.

Even when the orbit of tone generation level ratio (EG pan) ends during tone generation, operation is repeated for the fixed image position on the change orbit. Consequently, even when tone generation is continued for a long time, the change (pan effect) of tone generation level ratio is continued, and the change of musical tone is not lost. As a result, long tone or slow tempo music play expression can be enhanced.

Moreover, the tone generation level ratio (EG pan) can be changed according to the orbit after the musical tone is released (after key-off) according to tho orbit. Therefore, even when a musical tone, accompanied by a long release state (for example musical tone simulating the bell) is generated, the specific image position shift is continued until the end, and change of musical tone is not lost. Consequently, expression of play with tone color containing a long release state can be improved.

Since the output level ratio and composite level ratio can be controlled (pan control) by using several control means, complicated control) suited to play becomes possible, and the spread of musical tone can be improved. In the case when a musical tone is composed of several wave form elements, the above-mentioned control is applicable for each wave form element, which provides more diversified pan control and tone changes.

Because of the possibility of selecting one of the most proper means from many control means, it is possible to match a player's style.

What is claimed is:

1. An electronic musical instrument having a pan control function, comprising:

musical tone specifying means for specifying a musical tone signal to be generated;

means for forming the specified musical tone signal by synthesizing plural wave form elements;

a plurality of musical tone output means for outputting the musical tone signal simultaneously; and pan means for independently determining a synthesizing rate for each of the plural wave form elements in each of the musical tone output means.

2. An electronic musical instrument having a pan control function, comprising:

musical tone specifying means for specifying a musical tone signal to be generated;

means for forming the specified musical tone signal by synthesizing plural wave form elements;

a plurality of musical tone output means for outputting the musical tone signal simultaneously; and dynamic pan means for independently determining a synthesizing rate for each of the plural wave form elements in each of the musical tone output means, and for changing the synthesizing rate with lapse of time.

3. An electronic musical instrument having a pan control function, comprising:

musical tone specifying means for specifying a musical tone signal to be generated;

means for forming the specified musical tone signal by synthesizing plural wave form elements;

a plurality of musical tone output means for outputting the musical tone signal simultaneously;

static pan means for independently determining a fixed synthesizing rate for each of the plural wave form elements in each of the musical tone output means;

dynamic pan means for independently determining a synthesizing rate for each of the plural wave form elements in each of the musical tone output means, and for changing the synthesizing rate with lapse of time; and pan selection means for selecting the static pan means or the dynamic pan means.

4. An electronic musical instrument having a pan control function, comprising:

musical tone specifying means for specifying a musical tone signal to be generated;

means for forming the specified musical tone signal by synthesizing plural wave form elements;

a plurality of musical tone output means for outputting the musical tone signal simultaneously;

plural controllers, each changing a synthesizing rate of a different one of the plural wave form elements based on playing operation; and controller assignment means for assigning each controller to a different one of the wave form elements.

5. An electronic musical instrument having a pan control function, comprising:

musical tone specifying means for specifying a musical tone signal to be generated;

a plurality of musical tone output means for outputting the musical tone signal simultaneously;

envelope generator pan means for changing rates of output levels of the musical tone output means according to a pre-stored tone generation level ratio orbit having a specified image position; and loop means for performing repeatedly an envelope generator pan operation of the envelope generator pan means from the specified image position of the tone generation level ratio orbit when the tone generation level ratio orbit ends during generation of the musical tone signal.

6. An electronic musical instrument having a pan control function, comprising:

musical tone specifying means for specifying a musical tone signal to be generated;

a plurality of musical tone output means for outputting the musical tone signal simultaneously; and release pan means for changing rates of output levels of the musical tone output means according to a pre-stored tone generation level ratio orbit after the specified musical tone is being released.

7. An electronic musical instrument having a pan control function, comprising:

musical tone specifying means for specifying a musical tone signal to be generated;

a plurality of musical tone output means for outputting the musical tone signal simultaneously;

main control means for forming rates of output levels of the musical tone output means according to a parameter generated based on an operation of the musical tone specifying means;

subcontrol means for forming an output level rate between the musical tone output means according to a parameter generated based on an operation of specified means other than the musical tone specifying means; and synthesizing means for deciding final rates of output levels of the musical tone output means by synthesizing values generated by the main control means and the subcontrol means.

8. An electronic musical instrument having a pan control function according to claim 7, wherein said main control means and said subcontrol means can be selected optionally from plural parameters.

9. An electronic musical instrument having a pan control function, comprising:

musical tone specifying means for specifying a musical tone signal to be generated;

a plurality of musical tone output means for outputting the musical tone signal simultaneously;

main control means for forming rates of output levels of the musical tone output means according to a parameter generated based on an operation of the musical specifying means;

subcontrol means for forming an output level rate between the musical tone output means according to a parameter generated based on an operation of specified means other than the musical tone specifying means;

main depth storage means for storing main depth as a maximum control range of the main control means;

subdepth storage means for storing subdepth as a maximum control range of the subcontrol means; and synthesizing means for determining a final output level rate between the musical tone output means by synthesizing values which are obtained by multiplying a value generated based on the main control means by the main depth and by multiplying a value generated based on the subcontrol means by the subdepth.

10. An electronic musical instrument having a pan control function according to claim 8, wherein said main control means and said subcontrol means can be selected optionally from plural parameters.

11. An electronic musical instrument having a pan control function, comprising:

musical tone specifying means for specifying a musical tone signal to be generated;

means for forming the specified musical tone signal by synthesizing plural wave form elements;

a plurality of musical tone output means for outputting the musical tone signal simultaneously;

main control means for forming rates of output levels of each wave form element in the musical tone output means according to a parameter generated based on an operation of the musical tone specifying means;

subcontrol means for forming rates of output levels of each wave form element in the musical tone output means according to a parameter generated based on an operation of specified means other than the musical tone specifying means; and synthesizing means for determining final rates of output levels of each wave form element in the musical tone output means by synthesizing values generated by the main control means and the subcontrol means.

12. An electronic musical instrument having a pan control function according to claim 11, wherein said main control means and said subcontrol means can be selected optionally from plural parameters.

13. An electronic musical instrument having a pan control function, comprising:

musical tone specifying means for specifying a musical tone signal to be generated;

means for forming the specified musical tone signal by synthesizing plural wave form elements;

a plurality of musical tone output means for outputting the musical tone signal simultaneously;

main control means for forming rates of output levels of each wave form element in the musical tone output means according to a parameter generated based on an operation of the musical tone specifying means;

subcontrol means for forming rates output levels of each wave form element in the musical tone output means according to a parameter generated based on an operation of specified means other than the musical tone specifying means;

main depth storage means for storing main depth as a maximum control range of the main control means;

subdepth storage means for storing subdepth as a maximum control range of the subcontrol means; and synthesizing means for determining final rates of output levels of each wave form element in the musical tone output means by synthesizing values which are obtained by multiplying a value generated based on the main control means by the main depth and by multiplying a value generated based on the subcontrol means by the subdepth.

14. An electronic musical instrument having a pan control function according to claim 13, wherein said main control means and said subcontrol means can be selected optionally from plural parameters.

* * * * *